US005952289A

United States Patent [19]

Wise et al.

[11] Patent Number: 5,952,289

[45] Date of Patent: Sep. 14, 1999

[54] SOAP-BASED LAUNDRY BARS WITH IMPROVED FIRMNESS

[76] Inventors: Rodney Mahlon Wise; Robert Lindsay Apke; Iris Josefina Reyes Rojas, all of The Procter & Gamble Company, Ivorydale Technical Center, 5299 Spring Grove Ave., Cincinnati, Ohio 45217

[21] Appl. No.: 08/966,957

[22] Filed: Nov. 10, 1997

Related U.S. Application Data

[63] Continuation of application No. 08/434,670, May 12, 1995, abandoned.

[51] Int. Cl.[6] ..... C11D 17/00; C11D 3/48; C11D 3/00; C11D 3/02

[52] U.S. Cl. ..... 510/450; 510/389; 510/396; 510/399; 510/509; 510/510; 510/447

[58] Field of Search ..... 510/130, 145, 510/146, 141, 151, 152, 509, 155, 510, 156, 353, 357, 389, 447, 396, 399, 450

[56] References Cited

U.S. PATENT DOCUMENTS

| | | | |
|---|---|---|---|
| 2,649,417 | 8/1953 | Compa | 252/109 |
| 2,686,761 | 8/1954 | Ferguson et al. | 252/109 |
| 2,749,315 | 6/1956 | Faier | 252/117 |
| 2,781,321 | 2/1957 | Mayhew et al. | 252/161 |
| 2,845,391 | 7/1958 | Searle | 252/138 |
| 2,982,735 | 3/1961 | Blinka et al. | 252/121 |
| 2,991,253 | 7/1961 | Sheely et al. | 252/121 |
| 3,076,766 | 2/1963 | Anstett | 252/117 |
| 3,434,974 | 3/1969 | Austin et al. | 252/138 |
| 3,708,425 | 1/1973 | Compa et al. | 252/89 |
| 3,996,149 | 12/1976 | Burke, Jr. | 252/160 |
| 4,150,001 | 4/1979 | Sen | 252/539 |
| 4,162,236 | 7/1979 | Feierstein et al. | 252/558 |
| 4,233,173 | 11/1980 | Mayer et al. | 252/102 |
| 4,297,230 | 10/1981 | Rasser | 252/117 |
| 4,543,204 | 9/1985 | Gervasio | 252/531 |
| 4,705,644 | 11/1987 | Barone et al. | 252/135 |
| 4,721,581 | 1/1988 | Ramachandran et al. | 252/135 |
| 4,806,273 | 2/1989 | Barone et al. | 252/544 |
| 4,923,631 | 5/1990 | Sims et al. | 252/186.42 |
| 5,013,486 | 5/1991 | Joshi | 252/559 |
| 5,043,091 | 8/1991 | Joshi et al. | 252/174.17 |
| 5,069,825 | 12/1991 | Joshi et al. | 252/533 |
| 5,298,183 | 3/1994 | Connor et al. | 252/121 |

FOREIGN PATENT DOCUMENTS

| | | | |
|---|---|---|---|
| 8905607 | 5/1990 | Brazil | C11D 3/14 |
| 148181 | 11/1980 | India . | |
| 1346668 | 10/1987 | U.S.S.R. . | |
| 1276464 | 6/1972 | United Kingdom | C11D 1/24 |
| 3 141 965 | 1/1980 | United Kingdom | C11D 13/18 |
| 2 127 426 | 4/1984 | United Kingdom | C11D 3/08 |
| 2 181 739 | 4/1987 | United Kingdom | C11D 10/04 |
| 2 186 883 | 8/1987 | United Kingdom | C11D 9/40 |
| 2 189 255 | 10/1987 | United Kingdom | C11D 3/12 |

OTHER PUBLICATIONS

"Puffed Borax", *Soap and Chemical Specialties*, Jan. 1966, R. C. Rhees and H. N. Hammar, pp. 58–61, 118–120.

*Primary Examiner*—Necholus Ogden
*Attorney, Agent, or Firm*—Milton B. Graff; Daniel F. Nesbitt; Donald E. Hasse

[57] ABSTRACT

The subject invention involves laundry bar compositions comprising:

(a) from about 20% to about 70% surfactant, the surfactant consisting essentially of from about 50% to 100% soap and from 0% to about 50% alkylbenzene sulfonate;

(b) from about 12% to about 24% water;

(c) from about 6¼% to about 20% calculated excess alkali metal carbonate;

(d) from about 2% to about 20% water-soluble inorganic strong-electrolyte salt;

(e) from 0% to about 4% whole-cut starch;

(f) from 0% to about 8% added alkali metal bicarbonate;

(g) from 0% to about 30% phosphate builder;

(h) from 0% to about 40% insoluble filler; and (j) from 0% to about 15% other ingredients selected from other builders, chelants, enzymes, soil release polymers, dye transfer inhibiting agents, fabric softeners, bleaching agents, gums, thickeners, binding agents, other starches, soil suspending agents, optical brighteners, colorants and opacifiers, perfumes, bluing agents, and mixtures thereof;

the bar having a firmness measurement of at least about 10 kg.

The subject invention also involves processes for making such compositions.

16 Claims, No Drawings

SOAP-BASED LAUNDRY BARS WITH IMPROVED FIRMNESS

This is a continuation of application Ser. No. 08/434,670, filed on May 12, 1995 now abandoned.

TECHNICAL FIELD

The subject invention involves laundry bars in which soap is the sole or primary surfactant.

BACKGROUND OF THE INVENTION

Throughout the world, many people clean their clothes by hand washing with soap and/or detergent. A preferred form of cleansing product for hand washing of clothes is the laundry bar.

Soap, as it is typically produced from natural raw materials, has a relatively high level of water associated with it. Laundry bars which incorporate soap as the sole or predominant surfactant in them typically also contain a relatively high level of water. This high water level makes such laundry bars somewhat soft.

Consumers of laundry bars generally desire a very firm bar, to permit the bar to be rubbed vigorously across the surface of clothes in a scrubbing action without excessively abrading material from the surface of the bar. The drying of excess water from the soap raw material is costly, and often undesirable regarding the manufacturing process used to make the bars. Drying of excess water from the finished laundry bars is time consuming and costly when bars are manufactured on a large scale. Consequently, consumers often choose to unwrap newly purchased laundry bars, and set them out for long periods of time to dry and become more firm.

It is an object of the subject invention to provide laundry bars, in which the surfactant is at least half soap, the remainder being alkylbenzene sulfonate, with good firmness.

It is a further object of the subject invention to provide such bars with a good balance of cleansing power and mildness to the user's skin.

It is also an object of the subject invention to provide processes for making such laundry bars.

SUMMARY OF THE INVENTION

The subject invention involves laundry bar compositions comprising:

(a) from about 20% to about 70% surfactant, the surfactant consisting essentially of from about 50% to 100% soap and from 0% to about 50% alkylbenzene sulfonate;

(b) from about 12% to about 24% water;

(c) from about 6¼% to about 20% calculated excess alkali metal carbonate;

(d) from about 2% to about 20% water-soluble inorganic strong-electrolyte salt;

(e) from 0% to about 4% whole-cut starch;

(f) from 0% to about 8% added alkali metal bicarbonate;

(g) from 0% to about 30% phosphate builder;

(h) from 0% to about 40% insoluble filler; and (j) from 0% to about 15% other ingredients selected from other builders, chelants, enzymes, soil release polymers, dye transfer inhibiting agents, fabric softeners, bleaching agents, gums, thickeners, binding agents, other starches, soil suspending agents, optical brighteners, colorants and opacifiers, bluing agents, perfumes, and mixtures thereof;

the bar having a firmness measurement of at least about 10 kg, after being aged at least one day, sealed.

The subject invention also involves processes for making such compositions.

DETAILED DESCRIPTION OF THE INVENTION

Laundry Bars

Laundry bars of the subject invention comprise from about 20% to about 70% surfactant, preferably from about 25% to about 65% surfactant, more preferably from about 30% to about 60% surfactant. The surfactant in the subject invention laundry bars comprises from about 50% to 100% soap, preferably from about 60% to about 90% soap, more preferably from about 65% to about 85% soap. The surfactant in the subject invention bars comprises from 0% to about 50% alkylbenzene sulfonate, preferably from about 10% to about 40% alkylbenzene sulfonate, more preferably from about 15% to about 35% alkylbenzene sulfonate. Preferably the surfactant of the subject invention laundry bars consists essentially of soap and alkylbenzene sulfonate.

As used herein, "soap" means salts of fatty acids. The fatty acids are straight or branch chain containing from about 8 to about 24 carbon atoms, preferably from about 10 to about 20 carbon atoms. The average carbon chain length for the fatty acid soaps is from about 12 to about 18 carbon atoms, preferably from about 14 to about 16 carbon atoms. Preferred salts of the fatty acids are alkali metal salts, such as sodium and potassium, especially sodium. Also preferred salts are ammonium and alkylolammonium salts.

The fatty acids of soaps useful in the subject invention bars are preferably obtained from natural sources such as plant or animal esters; examples include coconut oil, palm oil, palm kernel oil, olive oil, peanut oil, corn oil, sesame oil, rice bran oil, cottonseed oil, babassu oil, soybean oil, castor oil, tallow, whale oil, fish oil, grease, lard, and mixtures thereof. Preferred fatty acids are obtained from coconut oil, tallow, palm oil (palm stearin oil), palm kernel oil, and mixtures thereof. Fatty acids can be synthetically prepared, for example, by the oxidation of petroleum, or by hydrogenation of carbon monoxide by the Fischer-Tropsch process.

Alkali metal soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with materials with fatty acid mixtures which typically have an approximate carbon chain length distribution of 2% $C_{14}$, 29% $C_{16}$, 23% $C_{18}$, 2% palmitoleic, 41% oleic and 3% linoleic (the first three fatty acids listed are saturated). Other mixtures with similar distribution, such as those from palm oil and those derived from various animal tallows and lard, are also included within the term tallow. The tallow can also be hardened (i.e., hydrogenated) to convert part or all of the unsaturated fatty acid moieties to saturated fatty acid moieties.

The term "coconut oil" is used herein in connection with materials with fatty acid mixtures which typically have an approximate carbon chain length distribution of about 8% $C_8$, 7% $C_{10}$, 48% $C_{12}$, 17% $C_{14}$, 9% $C_{16}$, 2% $C_{18}$, 7% o 2% linoleic (the first six fatty acids listed being saturated). Other sources having similar carbon chain length distribution in their fatty acids, such as palm kernel oil and babassu oil, are included within the term coconut oil.

Preferred soap raw materials for the subject invention bars and processes are soaps made from mixtures of fatty acids from tallow and coconut oil. Typical mixtures have tallow-:coconut fatty acid ratios of 85:15, 80:20, 75:25, 70:30, and 50:50.

Preferred soap raw materials for the subject invention are neat soaps made by kettle (batch) or continuous saponification. Neat soaps typically comprise from about 65% to about 75%, preferably from about 67% to about 72%, alkali metal soap; from about 24% to about 34%, preferably from about 27% to about 32%, water; and minor amounts, preferably less than about 1% total, of residual materials and impurities, such as alkali metal chlorides, alkali metal hydroxides, alkali metal carbonates, glycerin, and free fatty acids. Another preferred soap raw material is soap noodles or flakes, which are typically neat soap which has been dried to a water content of from about 10% to about 20%. The other components above are proportionally concentrated.

As used herein, alkylbenzene sulfonates means salts of alkylbenzene sulfonic acid with an alkyl portion which is straight chain or branch chain, preferably having from about 8 to about 18 carbon atoms, more preferably from about 10 to about 16 carbon atoms. The alkyl chains of the alkylbenzene sulfonic acid preferably have an average chain length of from about 11 to about 14 carbon atoms. Branched chain or mixed branched and straight chain alkylbenzene sulfonates are known as ABS. Straight chain alkylbenzene sulfonates, known as LAS, are more biodegradable than ABS. The acid forms of ABS and LAS are referred to herein as HABS and HLAS, respectively.

The salts of the alkylbenzene sulfonic acids are preferably the alkali metal salts, such as sodium and potassium, especially sodium. Salts of the alkylbenzene sulfonic acids also include ammonium.

Alkylbenzene sulfonates and processes for making them are disclosed in U.S. Pat. Nos. 2,220,099 and 2,477,383, incorporated herein by reference.

While alkylbenzene sulfonates help to impart good cleaning performance in laundry bars, it has been found that they also tend to cause an undesired softness of the bars.

The water content of the laundry bars of the subject invention generally depends on the amount of soap in the bar, since much of the water enters the subject process with the soap raw material. Water is also often added in the process for making the subject invention bars to facilitate processing of the bars. Typically, such water is added to facilitate mixing and/or reaction of the materials. When HLAS or HABS are added and are to be neutralized by alkali metal carbonate, water is preferably added to aid dissolution of the carbonate and its reaction with the alkylbenzene sulfonic acid. Materials incorporated in the bars may be added in aqueous solution in order to facilitate distribution of the material in the bars. In particular, sulfate salts, or at least a portion of them, are preferably incorporated in the bars by the addition of aqueous solutions of them.

The water content of the laundry bars of the subject invention is from about 12% to about 24%, preferably from about 14% to about 22%, more preferably from about 15% to about 21%, more preferably still from about 16% to about 20%.

When alkylbenzene sulfonate surfactant is incorporated in the subject development bars, the corresponding alkylbenzene sulfonic acid is preferably used as a raw material. The acid is typically neutralized during the process of making the bars in a mixing step. Alkali metal carbonates are typically used as the neutralizing material. Preferred alkali metal carbonates are sodium and potassium carbonates, especially sodium carbonate. In prior art processes for making bars with alkylbenzene sulfonates, a small excess of alkali metal carbonate is typically incorporated in such bars to ensure complete neutralization of the acid.

Applicants have found that an unusually firm laundry bar can surprisingly be obtained when a substantial excess of alkali metal carbonate is incorporated in the subject invention laundry bars. A small amount of this residual alkali metal carbonate exists as the bicarbonate form, due to incomplete local neutralization of the alkylbenzenesulfonic acid. The calculated excess amount of alkali metal carbonate incorporated in the subject invention bars (beyond that needed to neutralize any surfactant acids: HLAS, HABS, and/or fatty acids) is from about 6¼% to about 20% (bar weight basis), preferably from about 6½% to about 16%, more preferably still from about 7% to about 14%, still more preferably from about 8% to about 12%.

The percentages of the preceding paragraph are calculated values in that they assume that each carbonate ion involved in the neutralization reaction reacts with two hydrogens from the acids. Sometimes a carbonate ion reacts with only one hydrogen resulting in formation of a bicarbonate ion. Of the above calculated excess alkali metal carbonate, less than about 2% (bar weight basis) typically exists in the bars as alkali metal bicarbonate, more typically less than about 1%.

In order to obtain the desired firmness in the subject invention laundry bars, it is also necessary to incorporate a water-soluble inorganic strong-electrolyte salt in the composition, sufficient to achieve a minimum electrolyte content. As used herein, "strong-electrolyte salt" excludes carbonates, bicarbonates, builders, and other inorganic materials disclosed herein as subject bar components, but which are water-soluble inorganic weak electrolyte salts. Preferred water-soluble inorganic strong-electrolyte salts suitable for incorporation in the subject invention bars include the alkali metal, preferably sodium and potassium, sulfates and halides, preferably chlorides, and mixtures thereof. Particularly preferred salts include sodium sulfate and sodium chloride, and mixtures thereof. Sodium sulfate is particularly preferred because it is less corrosive to equipment than sodium chloride. The amount of such salts incorporated in the subject bars is from about 2% to about 20%, preferably from about 2½% to about 15%, more preferably from about 3% to about 10%, more preferably still from about 4% to about 8%.

An optional ingredient for incorporation in the subject invention laundry bars is starch. Starch helps provide additional firmness for such bars. Preferred starches for incorporation in the bars include whole-cut corn starch, tapioca-type starches, and other starches with similar properties and which are not pregelatinized, collectively referred to herein as "whole-cut" starches. Non-limiting examples of whole-cut powdered starches useful in the subject invention are Pearl® corn starch from A. E. Staley Manufacturing Company and Argo® corn starch from CPC International. For these preferred whole-cut starches, the amount incorporated in the subject development bars is from 0% to about 4%, preferably from about 1% to about 3%.

Starch derivatives such as pregelatinized starches, amylopectins, and dextrins, referred to herein as "other starches", can also be used to give the bars of the subject invention some additional firmness and particular physical properties, as described in U.S. Pat. No. 4,100,097 issued to O'Roark Jul. 11, 1978 and assigned to Hewitt Soap Co. The amount of other starches incorporated in the subject bars is from 0% to about 10%.

The incorporation of a high level of alkali metal carbonate in the subject invention bars results in a high pH wash solution, when the bar is used to wash clothes. Such high pH wash solution can be harsh to human skin. Such harshness can be reduced by incorporating an alkali metal bicarbonate in the subject invention bars, in addition to the residual bicarbonate mentioned above. Such alkali metal bicarbonates include sodium bicarbonate and potassium bicarbonate, especially sodium bicarbonate. The amount of additional alkali metal bicarbonate incorporated in the subject bars is from 0% to about 8% (bar weight basis), preferably from about 0.5% to about 5%, more preferably from about 1% to about 4%. The preferred amount of additional alkali metal bicarbonate incorporated in the subject bars is from about 1% to about 2%, especially about 1.5%, alkali metal bicarbonate for each additional 4% of excess alkali metal carbonate over 4% (all %'s are bar weight basis). For example, if the excess alkali metal carbonate is about 8%, the most preferred amount of additional alkali metal bicarbonate is about 1.5%; if the excess alkali metal carbonate is about 12%, the most preferred amount of additional alkali metal bicarbonate is about 3%.

The pH of a 1% aqueous solution of a bar composition of the subject invention is preferably from about 9.5 to about 10.8, more preferably from about 10.0 to about 10.5.

The laundry bars of the subject invention preferably comprise a builder capable of sequestering heavy metal ions in the wash water, in order to aid the clothes washing process. Preferred builders in the subject bars are the phosphate builders, which include alkali metal, ammonium and alkanolammonium salts of polyphosphates, exemplified by tripolyphosphates, pyrophosphates, and glassy polymeric metaphosphates. A preferred phosphate builder is sodium tripolyphosphate (STPP). Another preferred builder is tetrasodium pyrophosphate (TSPP). The subject bars comprise from 0% to about 30% phosphate builder, preferably from about 4% to about 20%, more preferably from about 5% to about 15%.

The subject invention laundry bars may also contain water-insoluble fillers, such as kaolinite, talc, and calcium carbonate. Clays, such as bentonite are used as fillers, but also provide some fabric softening benefit. Because some sulfates, such as sodium sulfate, are sparingly soluble in water, a large excess of such sulfate (over that which helps provide increased firmness for the bars, as disclosed hereinabove) can essentially be considered a water-insoluble filler. The amount of such insoluble fillers in the subject invention bars is from 0% to about 40%, preferably from about 5% to about 30%.

The subject invention laundry bars may contain other optional ingredients. Such other ingredients include other builders, such as aluminosilicates (especially zeolites), silicates, phosphonates, citrates, and polycarboxylates; chelants; enzymes, such as cellulase, lipase, amylase, and protease; soil release polymers; dye transfer inhibiting agents; fabrics softeners such as clays and quaternary ammonium compounds; bleaching agents; gums; thickeners; binding agents; soil suspending agents; optical brighteners; colorants and opacifiers such as titanium dioxide; bluing agents; perfumes. The amount of such other ingredients in the subject invention bars is from 0% to about 15%, preferably from about 1% to about 5%.

Process for Making Bars

Another aspect of the subject invention is a process for making the subject invention laundry bars having improved firmness. The process comprises the following steps:

(a) making a mixture, by mixing together in a mixer, raw materials to be incorporated in the laundry bars, the raw materials comprising:

(1) from about 20% to about 70% surfactant, the surfactant consisting essentially of from about 50% to 100% soap or an amount of fatty acids which will become such amount of soap when neutralized, and from 0% to about 50% alkylbenzene sulfonate or an amount of alkylbenzene sulfonic acid which will become such amount of alkylbenzene sulfonate when neutralized;

(2) from about 12% to about 24% water, including water fed to the mixer alone or in aqueous solutions and water associated with other raw materials fed to the mixer, (3) an amount of alkali metal carbonate such that, after neutralization of all the fatty acids and alkylbenzene sulfonic acids of (1), there is a calculated excess of from about 6¼% to about 20% alkali metal carbonate;

(4) from about 2% to about 20% water-soluble inorganic strong-electrolyte salt;

(5) from 0% to about 4% whole-cut starch;

(6) from about 0.5% to about 8% alkali metal bicarbonate;

(7) from 0% to about 30% phosphate builder;

(8) from 0% to about 40% insoluble filler; and (9) from 0% to about 15% other ingredients selected from other builders, chelants, enzymes, soil release polymers, dye transfer inhibiting agents, fabric softeners, bleaching agents, gums, thickeners, binding agents, other starches, soil suspending agents, optical brighteners, colorants and opacifiers, bluing agents, perfumes, and mixtures thereof;

the raw materials being fed to the mixer in a sequence such that any fatty acids and alkylbenzene sulfonic acid are neutralized by the alkali metal carbonate prior to the feeding of the alkali metal bicarbonate; whereby a thick paste is produced;

(b) optionally milling the mixture from step (a) between roll mills, whereby more intimate mixing of the raw materials is achieved and sheets or flakes of milled product are produced;

(c) extruding the product from step (a) or step (b) to produce an elongated, cohered product; and (d) cutting and shaping the product from step (c) to form laundry bars.

Typical mixers used in mixing step (a) are ribbon mixers, sigma-type mixers, soap amalgamators, and plow-type mixers (such as made by Littleford or by Loedige). Such mixers are water-jacketed for temperature control in the mixer, if necessary.

In mixing step (a), the alkali metal carbonate and water-soluble salts (other than those to be added in aqueous solution), and optionally other dry ingredients such as insoluble fillers and builders, are preferably first fed to the mixer and blended together. Preferably blended together in this first phase are the alkali metal carbonate, preferably sodium carbonate, the strong-electrolyte salt, preferably sodium sulfate or sodium chloride or a mixture of them, and insoluble fillers, preferably clays such as bentonite or calcium carbonate, if included in the bars to be produced.

Next the alkylbenzene sulfonic acid and fatty acids, if any, are preferably fed to the mixer, blended into the mixture, and neutralized by reaction with the alkali metal carbonate, resulting in the formation of some water and release of carbon dioxide. Any additional water or aqueous solution is also preferably fed to the mixer and blended in the mixture; the additional water helps the neutralization reaction to proceed to completion. When sodium sulfate is a strong-electrolyte inorganic salt, at least about 0.5% (total mixture basis) of the sodium sulfate is preferably fed to the mixer in aqueous solution.

Preferably the soap is next fed to the mixer and blended. The soap is preferably in the form of undried neat soap (preferably molton soap at a temperature of from about 70° C. to about 90° C.), or in the form of dried noodles or flakes, or both. The soap is preferably fed to the mixer along with or followed by the phosphate builder (if not added earlier), starch, bicarbonate, colorant/opacifier, and other particulate materials. It is particularly preferred that the starch be added after any free water or aqueous solution is blended into the mixture. Preferably any potentially unstable or volatile materials, such as some optical brighteners, soil release polymers, and perfumes, are fed to the mixer near the end of the mixing step, and blended for a short length of time to adequately disperse them in the mixture. The resulting mixture is then discharged from the mixer, preferably at a temperature of from about 50° C. to about 70° C.

The mixture from the mixer (at about 50° C. to about 70° C.) is preferably fed through roll mills to provide more intimate mixing of the materials in the mixture. Roll mills used for this purpose are those typical of soap milling processes. Three-roll to five-roll mills are commonly used. The mill rolls are preferably water cooled internally by ambient temperature water or a lower temperature refrigerant. Milling occurs by passing the largely solidified but still plastic mixture between the series of rotating rolls, successive members of the series rotating at higher speeds and closer clearances, the mixture being thus subjected to mechanical working, shearing, and compacting. The product emerges from the roll mills as flakes, or sheets which are broken into flakes.

The milling helps to eliminate speckling in the bars, which can occur due to incomplete mixing of the ingredients. The milling can also modify the crystalline phase of the soap making it more consistent and hard. It is preferred, but not required, that the soap be primarily in beta crystalline phase after milling.

The milled or mixed product is then typically plodded (extruded) using standard bar-making equipment and well-known methods to produce an elongated, cohered product which is then cut and shaped into bars using standard, well-known equipment and methods. Plodding of the flakes is preferably carried out in a dual stage plodder that allows use of a vacuum; for example, in a Mazzoni Duplex Vacuum Plodder®. The plodding is preferably carried out in the plodder at a temperature sufficient to produce an extruded solid having a temperature preferably in the range of from about 40° C. to about 50° C. It is preferred that the extruder head be maintained at a temperature of from about 60° C. to about 80° C. A vacuum of about 40 cm Hg or greater is preferably applied to the intermediate plodder chamber; this helps provide improved binding and a smooth finish on the surface of the plodded product.

TEST PROCEDURES

The following procedures are used to determine hardness and firmness of laundry bars:

Penetration Test for Bar Hardness

A measure of the bar hardness is obtained for aged bars, by the depth penetrated by the penetrometer needle.

| Apparatus: | |
|---|---|
| Penetrometer: | Dow Penetrometer or Precision Universal Penetrometer |
| Needle, shaft, collar: | Wt. 47 gram. Additional 100 g and 50 g weights to put on top of the needle shaft. Use the total 150 grams of additional weight on the needle shaft for the aged bars. |
| 32° C.: Constant temperature room or oven | |

Precautions:

1. Always protect the penetrometer needle with a rubber stopper when not being used. Never let it impact a metal surface.
2. If the needle point and cone become blunt or dented, have it re-machined.

Sample Preparation and Procedure:

Bars must be at least 1 to 2 days old before testing, and be protected while aging to prevent drying. Wrap bars in polyethylene and equilibrate the wrapped bars at ambient temperature for at least one day before testing. Determine the penetration at ambient room temperature.

Penetrometer Method:

1. Place the required additional weight on the penetration cone (needle) shaft.
2. Squeeze the cone release on the front of the penetrometer and raise it to its uppermost position. Also raise the depth gauge rod to its uppermost position. The scale indicator should read zero.
3. Now, while holding the cone, slowly lower it by pressing the finger release, until there is a slight deflection on the indicator reading. Release the finger release thus locking the cone in its position. This is the zero depth for the penetrometer.
4. Place bar on a smooth flat surface (i.e., flat metal plate) for stability.
5. Lower the penetrometer frame until the penetration cone (needle) is just in contact with the surface of the bar.
6. Now raise the cone to the uppermost position by pressing the finger release. Release the finger release and secure the cone in the uppermost position.
7. Lower the depth gauge rod (push on top of it) for a minimum of at least one half turn on the indicator scale.
8. Now press the finger release switch and allow penetration cone to fall into the bar.
9. Raise the depth gauge rod until it stops. The scale reading is the depth penetrated by the penetrometer needle in 0.1 mm units.
10. Read penetrations on the flat area next to the logo of the bar. Take at least two readings. If they disagree by more than two units, take additional readings; report the average of the first two readings which agree within two units.

The hardness of bars of the subject invention which have been aged for one day or more, preferably for one day, while being wrapped, sealed, or otherwise protected from ambient air exposure during aging, determined by using the above penetration method, is preferably no more than about 7.5 mm, more preferably no more than about 7.0 mm; preferably the penetration hardness of such bars is from about 4.0 mm to about 6.8 mm, more preferably from about 5.0 mm to about 6.5 mm.

Pressure Test for Bar Firmness

A measurement is made of the pressure needed to dent the surface of a bar with a rounded disc to a depth of about 6.4 mm. A pan head machine screw head is used to simulate the pressure of a finger on the bar surface, a common way of determining firmness by hand.

| Apparatus: | |
|---|---|
| Force Gauge: | Shimpo model FG-40R digital display, 20 kg force range. |
| Motorized Test Stand: | Shimpo model FGS-50C vertical motorized force gauge stand. |
| Penetration Head Piece: | A 6 mm pan head machine screw (M6 × 1.0), having a head with a diameter of about 11.7 mm (specification of 11.5 mm to 12.0 mm), threaded onto the force gauge. |

Set-up:

Mount the force gauge to the test stand in position to be driven vertically downward with force onto bar sample mounted on a hard raised surface. The gauge is set to read peak pressure in kilograms. Drive speed setting on the test stand motor is speed #5.

Sample Preparation:

Pre-condition the laundry bar sample prior to measuring firmness by aging for at least one day after making, the bar being sealed and stored during aging in polyethylene wrap or bags or other protective material, to protect it from ambient air drying.

Method:

1. Place bar on raised surface under force gauge. Calibrate on a sample bar of the proper dimensions, so that depth shut-off sensor is set to allow the screw head to penetrate at least 6.4 mm below the bar surface, but not more than 9.5 mm, before automatic drive shut-off.

2. Set drive speed to #5, and turn on drive and force gauge. Set gauge for peak pressure and zero the display.

3. Center the head of the attached pan head screw over a flat portion of bar and about 25 mm or more from an edge, so that bar breakage or distortion is avoided.

4. Start the drive downward through the surface of bar until the shut-off depth is reached. The screw head travels the vertical distance at a speed of about 8.6 mm/sec. Peak pressure is usually reached before the shut-off is reached.

5. Read the peak penetration pressure and record. Reset the equipment and take a total of three readings, if possible, averaging them for firmness result, in kilograms.

The firmness of bars of the subject invention which have been aged for one day or more, preferably for one day, while being wrapped, sealed, or otherwise protected from ambient air exposure during aging, determined by using the above pressure test method, is at least about 10 kg; preferably the pressure test firmness of such bars is from about 11 kg to about 30 kg, more preferably from about 12 kg to about 25 kg, more preferably still from about 14 kg to about 22 kg.

EXAMPLES

The following exemplify the laundry bar products and processes for making them of the subject invention, but are not intended to limit the scope of the subject invention.

Example 1

The following raw materials are combined to produce laundry bars of the subject invention.

| Raw Material | Amount (%) |
|---|---|
| HLAS | 11.75 |
| Molten Soap | 50.16 |
| Dried Soap Flakes | 11.38 |
| STPP | 5.00 |
| Starch | 3.00 |
| Sodium Carbonate | 10.08 |
| Sodium Bicarbonate | 2.00 |
| Brightener | 0.03 |
| Perfume | 0.45 |
| Sodium Sulfate | 3.00 |
| Titanium Dioxide | 1.00 |
| Bentonite Clay | 1.39 |
| Water | 1.62 |

The molten soap and dried soap flake raw materials used are neat soap made from a tallow/coconut fatty acid blend (approximately 75/25 ratio), the fatty acids being straight chain and a mixture of saturated and unsaturated and having an average chain length of about 16 carbons, and the fatty acids having been neutralized by a stoicheometric amount of NaOH. The molten soap is added in a fluid state at a temperature of 68° C. The molten soap composition is 68.2% soap, 30.9% water, 0.65% sodium chloride, and balance glycerin and excess NaOH. The dried flake soap is composed of the same neat soap, milled and dried to 85.9% soap, 13.0% water, and balance NaCl, NaOH, and glycerin.

The starch raw material used is Pearl® cornstarch from A. E. Staley Co.

Quantities of the above raw materials are used to make a 30 kg batch using a Littleford FM-130D mixer, run at a speed of about 140 rpm; water at a temperature of 77° C. is circulated through the mixer jacket. The sodium carbonate, bentonite day, and 2.5 parts of the 3.0 parts total sodium sulfate are fed to the mixer and blended for about 30 seconds. The HLAS is pumped into the mixer, mixed for about 1 minute, and the balance of sodium sulfate dissolved in warm water is fed to the mixer. Neutralization of the HLAS by the sodium carbonate is allowed to proceed, with mixing, for about 1 minute. The agitator is turned off, and the molten soap and dried soap flakes are fed to the mixer and mixed for about 3 minutes. STPP, starch, sodium bicarbonate and titanium dioxide are fed to the mixer and blended for about 1 minute. The brightener and other minor ingredients are fed to the mixer and blended for about 1 minute. The perfume is fed to the mixer and blended for about 1 minute. The mixture is discharged from the mixer in the form of a thick paste.

The thick paste from the mixer batch is then fed continuously from a surge hopper through a three-roll mill, with rolls cooled by city tap water (approximately 20° C.). The rolls are approximately 7 inches in diameter and 20 inches wide. The product is given three passes to generate sufficient work to further mix the ingredients, disperse lumps, and harden the phase structure of soap and LAS.

The resultant flaked product is fed into a Mazzoni Duplex B-100® plodder with two twinscrew plodding stages and an intermediate vacuum stage operating at about 60 cm Hg. Water at 40–50° C. is passed through jacketing of the plodder to maintain an exiting bar temperature of 35–45° C. A die at the exit of the plodder forms a rectangular rod of product which is about 55 cm by about 25 cm in cross section; the rod is cut to desired bar length. The bars can optionally be stamped in a mold while warm to achieve desired bar shape and logos.

The product produced by the above process contains the following.

| Component | Amount (%) |
|---|---|
| LAS | 12.00 |
| Soap | 44.00 |
| STPP | 5.00 |
| Starch | 3.00 |
| Sodium Carbonate (calculated residual) | 8.00 |
| Sodium Bicarbonate (added) | 2.00 |
| Brightener | 0.03 |
| Perfume | 0.45 |
| Sodium Sulfate | 3.29 |
| Titanium Dioxide | 1.00 |
| Bentonite Clay | 1.39 |
| Water | 19.00 |
| Sodium Chloride (from soap stock) | 0.42 |
| Miscellaneous | 0.42 |

The miscellaneous material in this example and examples below is impurities which are included in the raw materials such as the soap and alkylbenzene sulfonic acid; it is largely composed of glycerin, alkali metal hydroxide, unsaponified organic material, and unsulfonated alkylbenzene.

Examples 2–4

Products having the following compositions are made by the procedure of Example 1, except as indicated below.

| | Example | | |
|---|---|---|---|
| Component | 2 | 3 | 4 |
| | Amount (%) | | |
| LAS | 12.00 | 12.00 | 12.00 |
| Soap | 44.00 | 44.00 | 44.00 |
| STPP | 5.00 | 5.00 | 5.00 |
| Starch | 3.00 | 0.00 | 3.00 |
| Sodium Carbonate (calculated residual) | 8.00 | 8.00 | 8.24 |
| Sodium Bicarbonate (added) | 2.00 | 2.00 | 0.00 |
| Brightener | 0.03 | 0.03 | 0.03 |
| Sodium Sulfate | | | |
| from other sources | 0.29 | 0.29 | 0.29 |
| added dry in "seat" | 0.00 | 0.00 | 3.00 |
| slurried in 1% water | 2.00 | 2.00 | 0.00 |
| Sodium Chloride | | | |
| from soap stock | 0.42 | 0.42 | 0.42 |
| added dry in "seat" | 0.00 | 0.00 | 1.58 |
| Colorants | 0.02 | 0.02 | 0.02 |
| Perfume | 0.45 | 0.45 | 0.45 |
| Water | 19.50 | 19.50 | 19.50 |
| Miscellaneous | 0.51 | 0.51 | 0.51 |
| Bentonite Clay | balance | balance | balance |

In Examples 2–4, the "seat" is the starting dry powders fed to the mixer to begin a batch. The approximately 1% water used for slurrying the 2% sodium sulfate is fed to the mixer following feeding of the HLAS, to enhance carbonate neutralization of the HLAS. It is estimated that about 0.5% sodium sulfate dissolves in the warm water (35–60° C.) before addition to the mixer.

Examples 5–8

Products having the following compositions are made by the procedure of Example 1, except as indicated below.

| | Example | | | |
|---|---|---|---|---|
| Component | 5 | 6 | 7 | 8 |
| | Amount (%) | | | |
| LAS | 12.00 | 12.00 | 12.00 | 12.00 |
| Soap | 44.00 | 44.00 | 44.00 | 44.00 |
| STPP | 4.00 | 4.00 | 4.00 | 4.00 |
| Starch | 2.50 | 2.50 | 2.50 | 2.50 |
| Sodium Carbonate (calculated residual) | 7.00 | 8.00 | 10.00 | 12.00 |
| Sodium Bicarbonate (added) | 1.13 | 1.50 | 2.25 | 3.00 |
| Sodium Sulfate | | | | |
| from other sources | 0.29 | 0.29 | 0.29 | 0.29 |
| added dry in "seat" | 1.50 | 1.50 | 1.50 | 1.50 |
| dissolved in 1% water | 0.50 | 0.50 | 0.50 | 0.50 |
| Sodium Chloride (from soap stock) | 0.42 | 0.42 | 0.42 | 0.42 |
| Perfume | 0.37 | 0.37 | 0.37 | 0.37 |
| Water | 19.00 | 19.00 | 19.00 | 19.00 |
| Miscellaneous | 0.42 | 0.42 | 0.42 | 0.42 |
| Bentonite Clay | balance | balance | balance | balance |

In Examples 5–8, the "seat" is the starting dry powders fed to the mixer to begin a batch. The 1% water with the dissolved 0.5% sodium sulfate is fed to the mixer following feeding of the HLAS.

Examples 9–12

Products having the following compositions are made by the procedure of Example 1, except as indicated below.

| | Example | | | |
|---|---|---|---|---|
| Component | 9 | 10 | 11 | 12 |
| | Amount (%) | | | |
| LAS | 16.00 | 16.00 | 16.00 | 17.00 |
| Soap | 29.00 | 29.00 | 29.00 | 18.00 |
| STPP | 5.00 | 5.00 | 5.00 | 8.00 |
| Starch | 3.00 | 3.00 | 3.00 | 3.50 |
| Sodium Carbonate (calculated residual) | 7.00 | 8.00 | 10.00 | 8.00 |
| Sodium Bicarbonate (added) | 1.13 | 1.50 | 2.25 | 1.50 |
| Sodium Sulfate | | | | |
| from other sources | 0.39 | 0.39 | 0.39 | 0.41 |
| added dry in "seat" | 1.50 | 1.50 | 1.50 | 1.50 |
| dissolved in 1% water | 0.50 | 0.50 | 0.50 | 0.50 |
| Sodium Chloride | | | | |
| from soap stock | 0.42 | 0.42 | 0.42 | 0.17 |
| added dry in "seat" | 1.00 | 1.00 | 1.00 | 1.00 |
| Perfume | 0.45 | 0.45 | 0.45 | 0.45 |
| Water | 16.00 | 16.00 | 16.00 | 13.00 |
| Miscellaneous | 0.45 | 0.45 | 0.45 | 0.42 |
| Calcium Carbonate | balance | balance | balance | balance |

In Examples 9–12, the "seat" is the starting dry powders fed to the mixer to begin a batch. The 1% water with the dissolved 0.5% sodium sulfate is fed to the mixer following feeding of the HLAS.

Example 13

Product having the following composition is made by the procedure of Example 1, except as indicated below.

| Component | Example 13 Amount % |
|---|---|
| ABS | 12.00 |
| Soap | 44.00 |
| STPP | 5.00 |
| Starch | 3.00 |
| Sodium Carbonate (calculated residual) | 8.00 |
| Sodium Bicarbonate (added) | 1.50 |
| Sodium Sulfate | |
| from other sources | 0.32 |
| added dry in "seat" | 2.50 |
| dissolved in 1% water | 0.50 |
| Sodium Chloride (from soap stock) | 0.42 |
| Perfume | 0.37 |
| Water | 19.00 |
| Misceallaneous | 0.34 |
| Calcium Carbonate | balance |

In Example 13, the "seat" is the starting dry powders fed to the mixer to begin a batch. HABS replaces HLAS as a raw material. The 1% water with the dissolved 0.5% sodium sulfate is fed to the mixer following feeding of the HABS.

Example 14

The following raw materials are combined to produce laundry bars of the subject invention.

| Raw Material | Amount (%) |
|---|---|
| HLAS | 11.85 |
| Tallow Fatty Acids | 32.60 |
| Coconut Fatty Acids | 7.95 |
| STPP | 5.00 |
| Bentonite Clay | 3.00 |
| Sodium Carbonate | 20.29 |
| Sodium Bicarbonate | 2.00 |
| Brightener | 0.03 |
| Bluing | 0.02 |
| Perfume | 0.45 |
| Talc | 1.63 |
| Water | 17.45 |
| Sodium Chloride | 2.00 |

The total of raw materials in the above table is 104.27%, allowing for the 4.27% carbon dioxide which dissipates from the mixture during processing.

Quantities of the above raw materials are used to make a 30 kg. batch using a Littleford FM-130D mixer, run at a speed of about 140 rpm; water at a temperature of 77° C. is circulated through the mixer jacket. The STPP, bentonite clay, sodium chloride, talc, and 19.29 parts of the 20.29 parts sodium carbonate are fed to the mixer. The fatty acids and HLAS are pumped into the mixer, mixed for about 1 minute, and the water is fed to the mixer. Neutralization of the HLAS and fatty acids by the sodium carbonate is allowed to proceed, with mixing, for about 3 minutes. The final 1 part of sodium carbonate is fed to the mixer and blended for about 1 minute. The sodium bicarbonate, brightener and bluing are fed to the mixer and blended for about 1 minute. The perfume is fed to the mixer and blended for about 1 minute. The mixture is discharged from the mixer in the form of a thick paste.

The thick paste from the mixer batch is milled and then plodded, cut and shaped into bars by the procedures described in Example 1.

The product produced by the above process contains the following.

| Component | Amount (%) |
|---|---|
| LAS | 12.00 |
| Tallow Soap | 35.20 |
| Coconut Soap | 8.80 |
| STPP | 5.00 |
| Bentonite Clay | 3.00 |
| Sodium Carbonate (calculated residual) | 10.00 |
| Sodium Bicarbonate (added) | 2.00 |
| Brightener | 0.03 |
| Bluing | 0.02 |
| Perfume | 0.45 |
| Sodium Sulfate | 0.22 |
| Miscellaneous | 0.34 |
| Talc | 1.36 |
| Water | 19.31 |
| Sodium Chloride | 2.00 |

While particular embodiments of the subject invention have been described, it would be obvious to those skilled in the art that various changes and modifications to the subject invention can be made without departing from the spirit and scope of the invention. It is intended to cover, in the appended claims, all such modifications that are within the scope of this invention.

What is claimed is:

1. A laundry bar composition comprising:

(a) from about 40% to about 70% surfactant, the surfactant consisting essentially of from about 50% to 100% alkali metal soap and from 0% to about 50% alkylbenzene sulfonate;

(b) from about 12% to about 24% water;

(c) from about 7% to about 14% alkali metal carbonate;

(d) from about 2% to about 20% water-soluble inorganic strong-electrolyte salt;

(e) from 0% to about 4% whole-cut starch;

(f) from 0% to about 8% added alkali metal bicarbonate;

(g) from 0% to about 30% phosphate builder;

(h) from 0% to about 40% insoluble filler; and (j) from 0% to about 15% other ingredients selected from the group consisting of other builders, chelants, enzymes, soil release polymers, dye transfer inhibiting agents, fabric softeners, bleaching agents, gums, thickeners, binding agents, other starches, soil suspending agents, optical brighteners, colorants and opacifiers, bluing agents, perfumes, and mixtures thereof;

the bar having a firmness measurement of at least about 10 kg, after being aged at least one day, sealed.

2. The composition of claim 1 wherein the surfactant consists essentially of from about 50% to about 90% soap, and from about 10% to about 50% alkylbenzene sulfonate.

3. The composition of claim 2 wherein the amount of alkali metal bicarbonate in the composition is sufficient such that a 1% aqueous solution of the composition has a pH of from about 9.5 to about 10.8.

4. The composition of claim 3 wherein the strong-electrolyte salt is a an alkali metal sulfate or chloride, or mixture thereof.

5. The composition of claim 4 wherein the amount of surfactant is from about 40% to about 65%.

6. The compositions of claim 5 wherein the the amount of added alkali metal bicarbonate is from about 0.5% to about 4%.

7. The composition of claim 6 wherein the amount of starch is from about 1% to about 3%.

8. The composition of claim 7 wherein the surfactant consists essentially of from about 60% to about 85% soap, wherein fatty acids of the soap are straight or branch chain having an average carbon chain length of from about 12 to about 18, and from about 15% to about 40% alkylbenzene sulfonate; wherein the alkyl portion is straight or branch chain with an average chain length of from about 11 to about 14 carbon atoms; and the amount of water is from about 14% to about 22%.

9. The composition of claim 6 wherein the amount of strong-electrolyte salt is from about 2½% to about 15%.

10. The composition of claim 6 wherein the amount of strong-electrolyte salt is from about 4% to about 10%, and the bar has a firmness measurement of from about 12 kg to about 30 kg.

11. The composition of claim 8 wherein the amount of strong-electrolyte salt is from about 4% to about 10%, the bar has a firmness measurement of from about 12 kg to about 25 kg, and the pH of a 1% aqueous solution of the composition is from about 10.0 to about 10.5.

12. The composition of claim 1, 5 or 11 wherein the cations of the soap, alkylbenzene sulfonate, carbonate, and bicarbonate are all sodium.

13. The composition of claim 1, 5 or 11 herein the alkyl portions of the soap and alkylbenzene sulfonate are straight chain.

14. The composition of claim 5 or 11 wherein the phosphate builder is sodium tripolyphosphate in the amount of from about 5% to about 15%.

15. The composition of claim 5 or 10 wherein the amount of water is from about 12% to about 21%.

16. The composition of claim 1, 5 or 11 wherein the amount of alkali metal carbonate is from about 8% to about 12%.

* * * * *